US007213632B1

(12) United States Patent
Goldstein et al.

(10) Patent No.: US 7,213,632 B1
(45) Date of Patent: May 8, 2007

(54) PORTABLE FOLDING ROOM DIVIDING PARTITION

(75) Inventors: Steven D. Goldstein, Plymouth, MN (US); Michael D. Edwards, Zimmerman, MN (US); William J. Mark, Troutman, NC (US)

(73) Assignee: Advanced Office Concepts Inc

( * ) Notice: Subject to any disclaimer, the term of this patent is extended or adjusted under 35 U.S.C. 154(b) by 292 days.

(21) Appl. No.: 10/802,215

(22) Filed: Mar. 17, 2004

(51) Int. Cl.
*A47G 5/00* (2006.01)

(52) U.S. Cl. ..... 160/135; 160/234

(58) Field of Classification Search ..... 160/135, 160/234, 351; 52/71; 16/29
See application file for complete search history.

(56) References Cited

U.S. PATENT DOCUMENTS

| | | | | |
|---|---|---|---|---|
| 373,794 | A | 11/1887 | Armbruster | |
| 420,668 | A | 2/1890 | Wallace | |
| 668,748 | A | 2/1901 | Buchanan | |
| 756,091 | A | 3/1904 | Altick | |
| 1,245,237 | A | 11/1917 | Johnston | |
| 1,410,225 | A | 3/1922 | Seaman | |
| 2,162,523 | A | 6/1939 | Blood et al. | |
| 2,784,779 | A * | 3/1957 | Knipfer et al. | 160/135 |
| 3,017,969 | A | 1/1962 | Nielsen | |
| 3,060,521 | A | 10/1962 | Greco | |
| 3,232,333 | A | 2/1966 | Dixon | |
| 3,330,611 | A | 7/1967 | Heifetz | |

(Continued)

FOREIGN PATENT DOCUMENTS

| | | |
|---|---|---|
| GB | 420320 | 7/1933 |

(Continued)

OTHER PUBLICATIONS

Advance Office Concepts, Panel Frame 25 Series Discount Feb. 6, 1989, One Page Advance Office Concepts, Product on Sale Minneapolis MN (Unpublished).

(Continued)

*Primary Examiner*—Blair M. Johnson
(74) *Attorney, Agent, or Firm*—James V. Harmon

(57) ABSTRACT

A portable folding room partition has typically five articulated panels with wheels including two panels located at the ends of the partition which comprise carrier panels that serve as stabilizing elements for imparting movement to several intermediate panels as the partition is folded or unfolded. Each of the carrier panels includes a vertical end frame member having a horizontal spread end foot with wheels rigidly connected to its lower end. A pull handle is connected to each carrier panel in a position aligned over each spread end foot. The intermediate panels also have wheels and are hingedly connected to one another between the carrier panels to define the partition. Movement of the carrier panels by persons gripping the pull handles acts to spread or collapse the inactive intermediate panels while providing them with stabilizing support at each end. In a preferred form, each of the carrier panels has a pair of spaced apart spreaders. Both spreaders have a wheel at each end on opposite sides of the panel. Vertical frame elements on the side edges of each panel include a pair of longitudinal slots. Flexible polymeric hinges that are held in the slots along their edges bend to permit articulation of the panels relative to each other. Provision is also made for locking the panels in alignment with one another to provide a wall-effect.

7 Claims, 7 Drawing Sheets

U.S. PATENT DOCUMENTS

| | | | | | |
|---|---|---|---|---|---|
| 3,387,413 | A | | 6/1968 | Huey | |
| 3,402,515 | A | | 9/1968 | Rainaut | |
| 3,438,421 | A | | 4/1969 | Catalano | |
| 3,534,512 | A | * | 10/1970 | Ballas | 52/67 |
| 3,565,152 | A | * | 2/1971 | Cohn et al. | 160/135 |
| 3,592,289 | A | * | 7/1971 | Aysta et al. | 160/135 |
| 3,629,982 | A | | 12/1971 | Bally | |
| 3,674,081 | A | | 7/1972 | List | |
| 3,677,322 | A | | 7/1972 | Brorson et al. | |
| 3,866,365 | A | | 2/1975 | Honigman | |
| 4,047,337 | A | | 9/1977 | Bergstrom | |
| 4,118,903 | A | * | 10/1978 | Coulthard | 160/351 |
| 4,161,850 | A | | 7/1979 | Peterson et al. | |
| 4,192,106 | A | | 3/1980 | Hell | |
| 4,194,313 | A | * | 3/1980 | Downing | 40/610 |
| 4,228,842 | A | * | 10/1980 | Clark | 160/234 |
| 4,450,658 | A | | 5/1984 | Legeai | |
| 4,569,163 | A | | 2/1986 | Long | |
| 4,932,172 | A | | 6/1990 | Maas | |
| D323,944 | S | | 2/1992 | Maas | |
| 5,092,385 | A | | 3/1992 | Beaulieu | |
| D330,646 | S | | 11/1992 | Maas | |
| 5,212,918 | A | | 5/1993 | Newhouse et al. | |
| 5,214,885 | A | | 6/1993 | Maas et al. | |
| 5,251,413 | A | | 10/1993 | Goodman | |
| 5,272,848 | A | * | 12/1993 | Maas | 52/238.1 |
| D345,018 | S | | 3/1994 | Maas | |
| 5,450,694 | A | | 9/1995 | Goranson et al. | |
| 5,515,899 | A | | 5/1996 | Chan | |
| 5,537,766 | A | | 7/1996 | Nickens et al. | |
| 5,560,413 | A | * | 10/1996 | Brown | 160/135 |
| 6,009,930 | A | * | 1/2000 | Jantschek | 160/135 |
| 6,598,649 | B1 | * | 7/2003 | Moore et al. | 160/135 |

FOREIGN PATENT DOCUMENTS

| | | |
|---|---|---|
| GB | 498323 | 7/1937 |

OTHER PUBLICATIONS

Advanced Office Concepts, Inc., Tote Divider Plus (catalog) Dated 2001, Published by Advanced Office Concepts, Inc. Shoreview, MN, 55126, USA.

* cited by examiner

PORTABLE FOLDING ROOM DIVIDING PARTITION

FIELD OF THE INVENTION

This invention relates to portable partitions for offices, homes and other buildings and more particularly to folding partitions and room dividers with wheels.

BACKGROUND OF THE INVENTION

The folding partitions or room dividers that have been previously proposed are often somewhat unstable as they are being expanded from a collapsed condition, particularly when handled by inexperienced persons such as students in a school setting. Another shortcoming of prior folding partitions is their high cost which has been due in part to the need for different kinds of structural members in various parts of each panel as well as the complex hinge structures that are required.

U.S. Pat. Nos. 6,009,930; 5,272,848; 5,214,885 and design 345,018 describe various forms of portable folding partitions with wheels but no provision is made for stabilizing panels at each end nor are handles provided for aligning the force exerted on the end panel in such as way as to help prevent the partition from tipping. For example, in U.S. Pat. No. 5,272,848, the curved posts 15 and can function as a handle but this structure allows a force to be applied at one side out of alignment with the panel itself making it more likely for the partition to tip over. In addition, the patent requires a rod-like vertical upright member to be attached to the end panels which adds to production costs. In U.S. Pat. No. 5,214,885, the partition is held by a cabinet room divider which customers seldom want.

It is therefore one important object of the present invention to provide a portable folding room divider or partition with wheels that is more stable than previously available so that it can be easily and safely expanded following storage or collapsed to a folded condition by untrained persons including people who have had no previous experience handling a partition including high school students and other untrained individuals.

It is a further object of the invention to provide an improved folding partition in which the same structural members are used on the top, bottom and sides of each panel to form a frame around the edge of each panel and no rod-like vertical upright member needs to be attached to the ends of the end panels.

A further object is to provide a simple hinge structure that is low in cost and can be assembled or replaced if worn in seconds by unskilled workers.

Yet another object is to provide an improved portable folding room partition of the type described having wheels positioned to provide stable support for the partition and to find a way of securely mounting wheel spreaders in a manner that prevents structural elements from bending or gradually working loose.

Still another object of the invention is to provide a portable folding room divider with a stabilizing carrier panel at each end and a plurality of intermediate panels hingedly connected between the carrier panels and adapted to move when the carrier panels are manipulated by handles provided on the carrier panels.

Another object is to find a way to enable forces to be applied manually in a manner and location that enhances the stability of the partition in the process of expanding or collapsing the partition.

Yet another object is to allow the user to easily achieve a wall-effect by maintaining the panels in precise alignment.

These and other more detailed and specific objects of the present invention will be better understood by reference to the following Figures and detailed description which illustrate by way of example but a few of the various forms of the invention within the scope of the appended claims.

SUMMARY OF THE INVENTION

The invention provides a portable folding room partition that has a plurality of articulated panels with wheels including two panels located at the ends of the partition which comprise carrier panels that serve as stabilizing elements for imparting movement to several intermediate panels as the partition is folded or unfolded. Each of the carrier panels includes a vertical end frame member having a horizontal spread end foot with wheels rigidly connected to its lower end. A pull handle is connected to each carrier panel in a position aligned over each spread end foot. The intermediate panels also have wheels and are hingedly connected to one another between the carrier panels to define the partition. Movement of the carrier panels by persons gripping the pull handles acts to spread or collapse the inactive intermediate panels while providing them with stabilizing support at each end. Since motion is imparted to them by the carrier panels, the intermediate panels can be thought of as inactive or idler panels. In a preferred form, each of the carrier panels has a pair of spaced apart spreaders. Both spreaders have a wheel at each end on opposite sides of the panel. Vertical frame elements on the side edges of each panel include a pair of longitudinal slots. Flexible polymeric hinges that are held in the slots along their edges bend to permit articulation of the panels relative to each other. Provision is also made for locking the panels in alignment with one another to provide a wall-effect.

DETAILED DESCRIPTION OF THE INVENTION

Figure 1A:
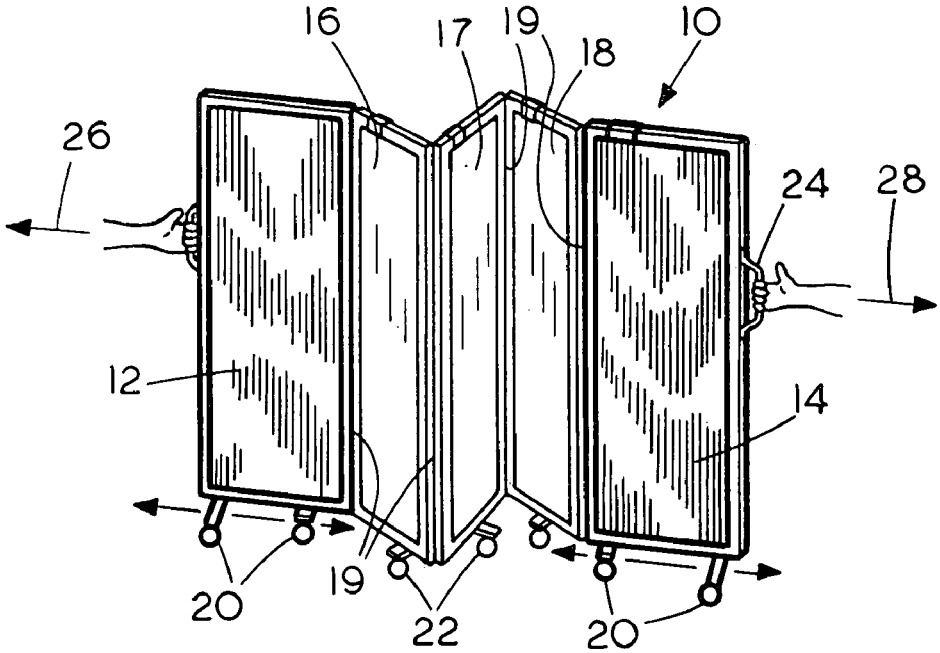
FIG. 1A is a perspective view showing the invention as it is being expanded from a collapsed condition.
Figure 1B:
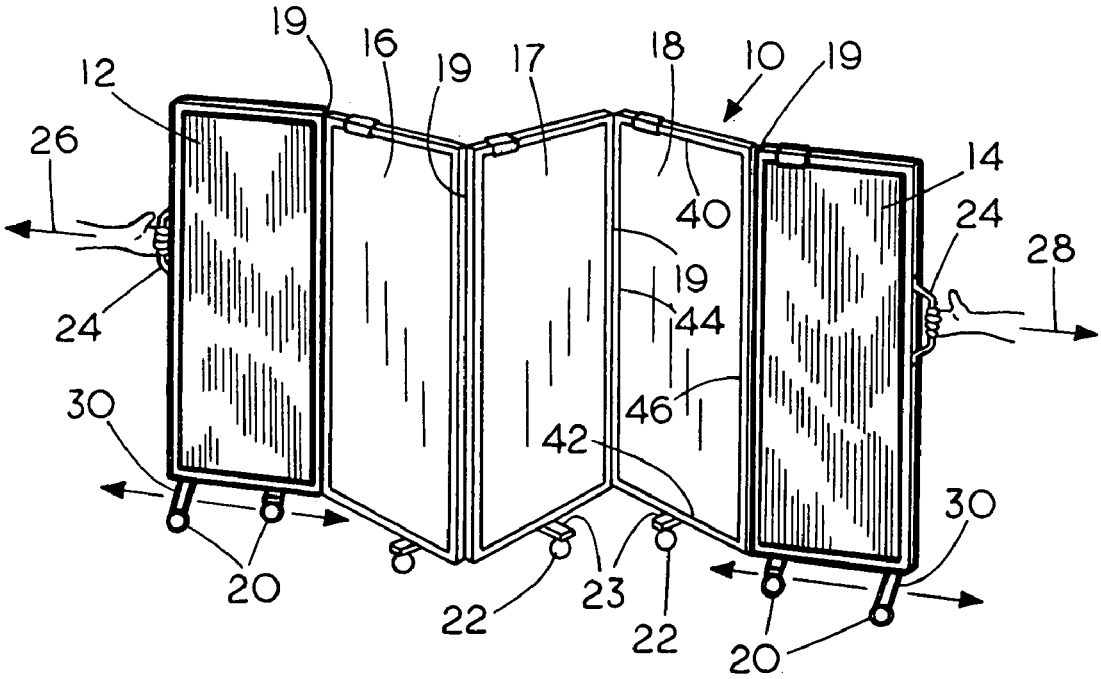
FIG. 1B is a perspective view showing the invention further expanded relative to FIG. 1.
Figure 2:
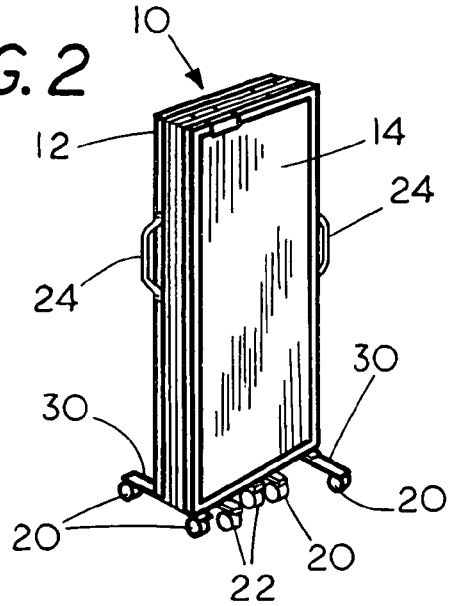
FIG. 2 is a perspective view showing the invention in a collapsed condition as it appears during storage.
Figure 3:
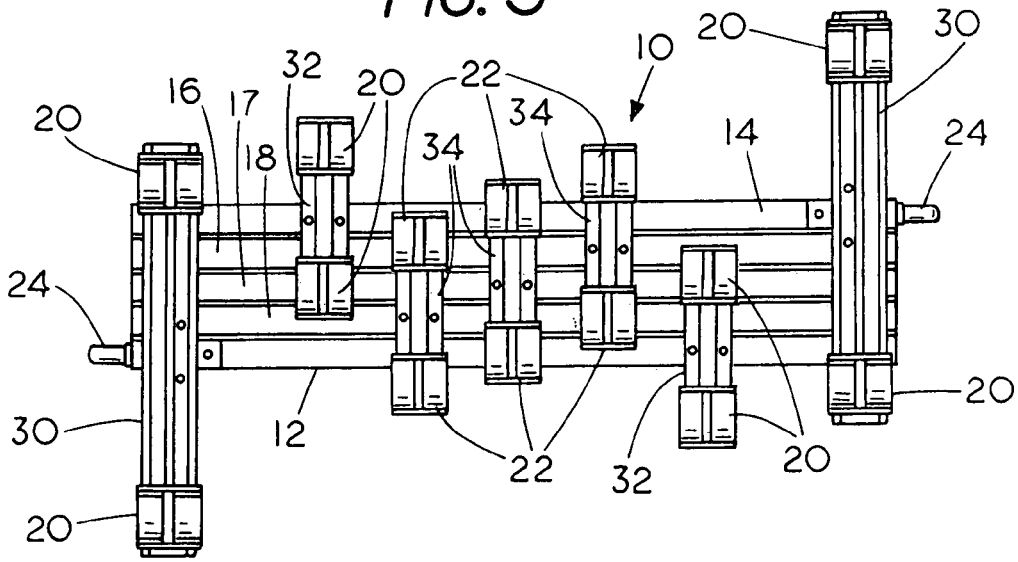
FIG. 3 is a bottom view of the invention in a collapsed condition.
Figure 4:
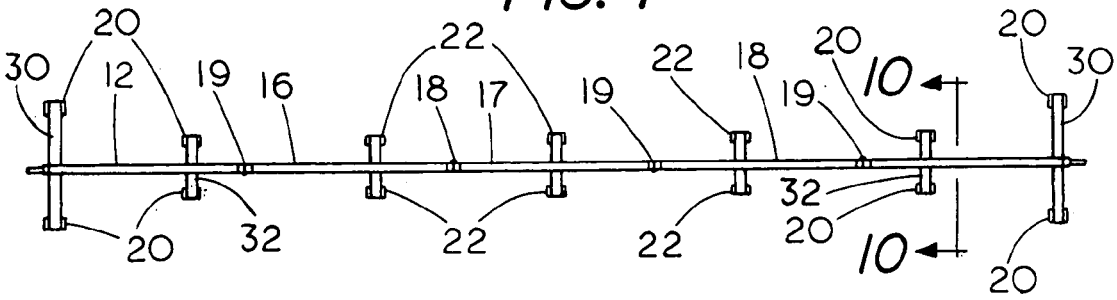
FIG. 4 is a top view of the invention in a fully expanded condition on a smaller scale than in FIG. 3.

Refer now to the Figures and particularly FIGS. 1–3 that illustrate a partition 10 embodying the invention which is provided with a pair of stabilizing carrier panels 12 and 14 at the ends of the partition and a plurality of intermediate or inactive partitions 16–18 that are hingedly connected for articulation relative to one another to enable the partition 10 to be unfolded from a compact storage position (FIG. 2) to an expanded condition (FIGS. 1A and 1B). Hinges between the panels are designated 19. The carrier panels 12 and 14 are each provided with four wheels 20, while the intermediate panels 16–18 are each provided with two wheels 22. All of the wheels 20 and 22 can be caster wheels of any suitable commercially available construction.

Refer especially to FIGS. 1A and 1B which illustrate how the partition 10 is expanded from a collapsed position. It will be seen that the carrier panels 12 and 14 are each provided with a pull handle 24 on its outer or free edge. Each pull handle is a vertically disposed U-shaped handle member that is aligned in the plane of the carrier panel to which it is attached and extends outwardly. To expand the partition the handles 24 are grasped manually and are pulled apart as shown progressively in FIGS. 1A and 1B which illustrates the partition as it is being expanded from a more collapsed position (FIG. 1A) to a more expanded condition (FIG. 1B) by persons pulling on the handles 24. It will be noticed by comparing FIGS. 1A and 1B that, with a force applied outwardly by means of the handles 24, the carrier panels 12 and 14 as well as all four of the wheels 20 on each of the carrier panels 12 and 14 will be in alignment with each other and in alignment with the manual spreading forces 26 and 28. Because of this alignment and the provision of four wheels on each of the carrier panels 12 and 14, the partition is very effectively stabilized by the carrier panels as it is put in place. It was found that good stability could be achieved with the carrier panels without the necessity of providing more than two wheels 22 for each of the intermediate idler panels 16–18 thereby minimizing production costs.

By reference to FIG. 3 it will be seen that the wheels 20 of the carrier panels 12 and 14 are mounted on the end of a horizontal spread end foot 30 typically 12–18 inches long as well as on a much shorter horizontal spread foot 32 typically about 5–10 inches long. Each of the intermediate idler panels 16–18 is provided with a short horizontal spread foot 34 typically 5–10 inches long to which the wheels 22 are connected. The horizontal spread feet are rigidly connected to the bottoms of the panels, e.g. by means of bolts or screws. The mounting of the horizontal spread end feet 30 at the ends of the carrier panels will be described more fully below.

Figure 7:
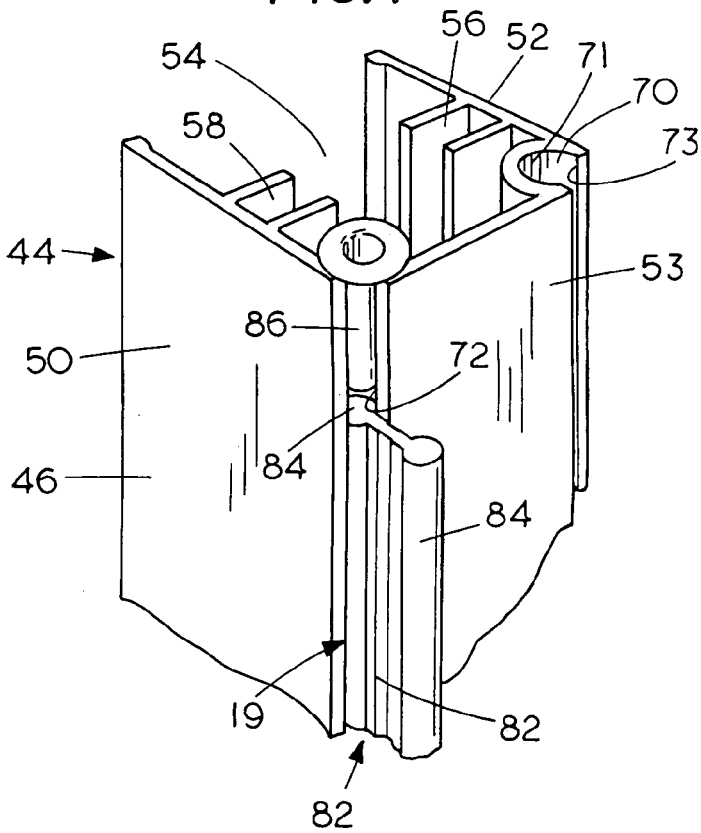
FIG. 7 is a greatly enlarged partial perspective view of a vertical frame element showing a section of polymeric hinge material connected thereto.
Figure 8:
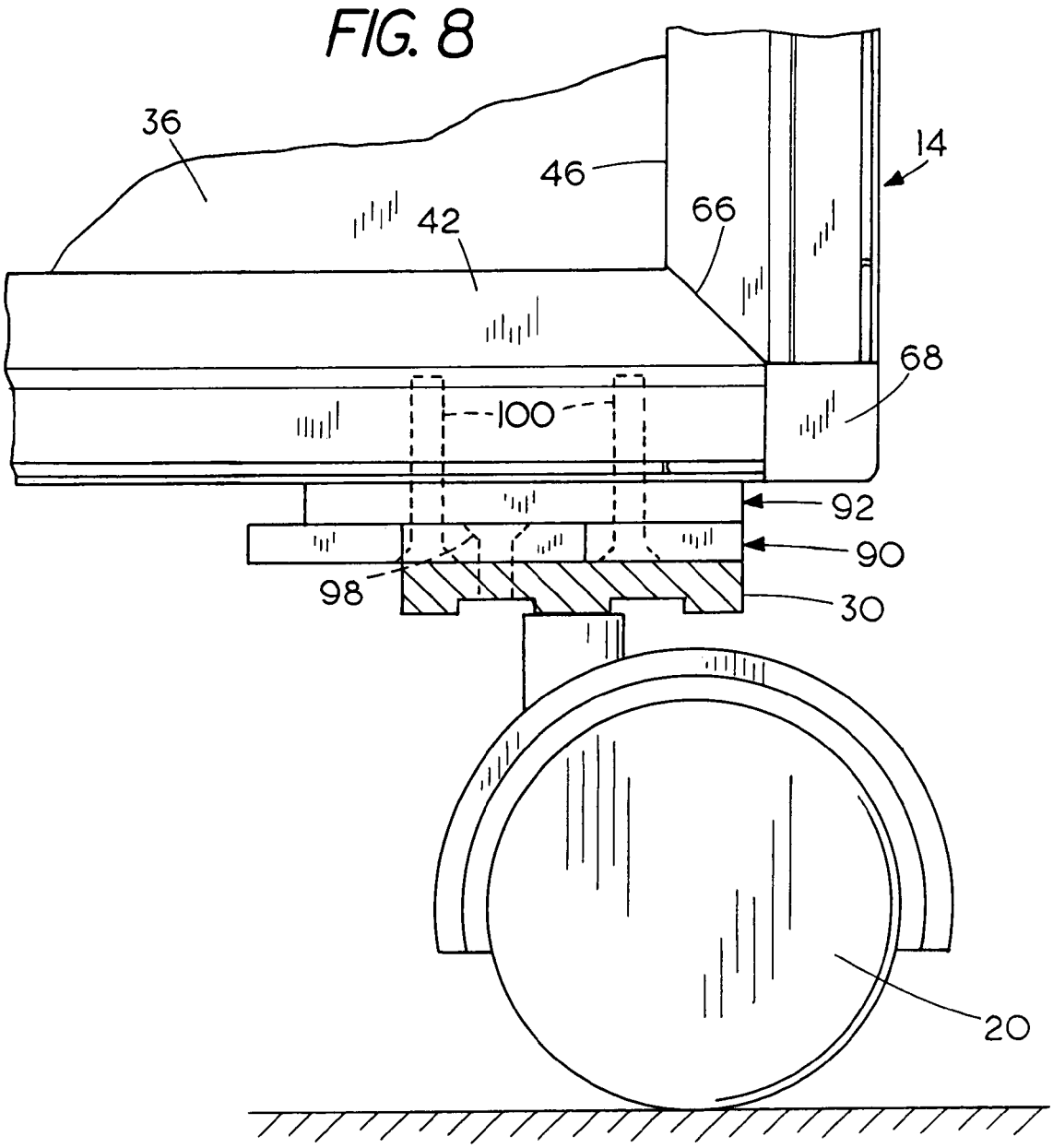
FIG. 8 is a partial side elevational view of the lower portion of a carrier panel partly in section.
Figure 11:
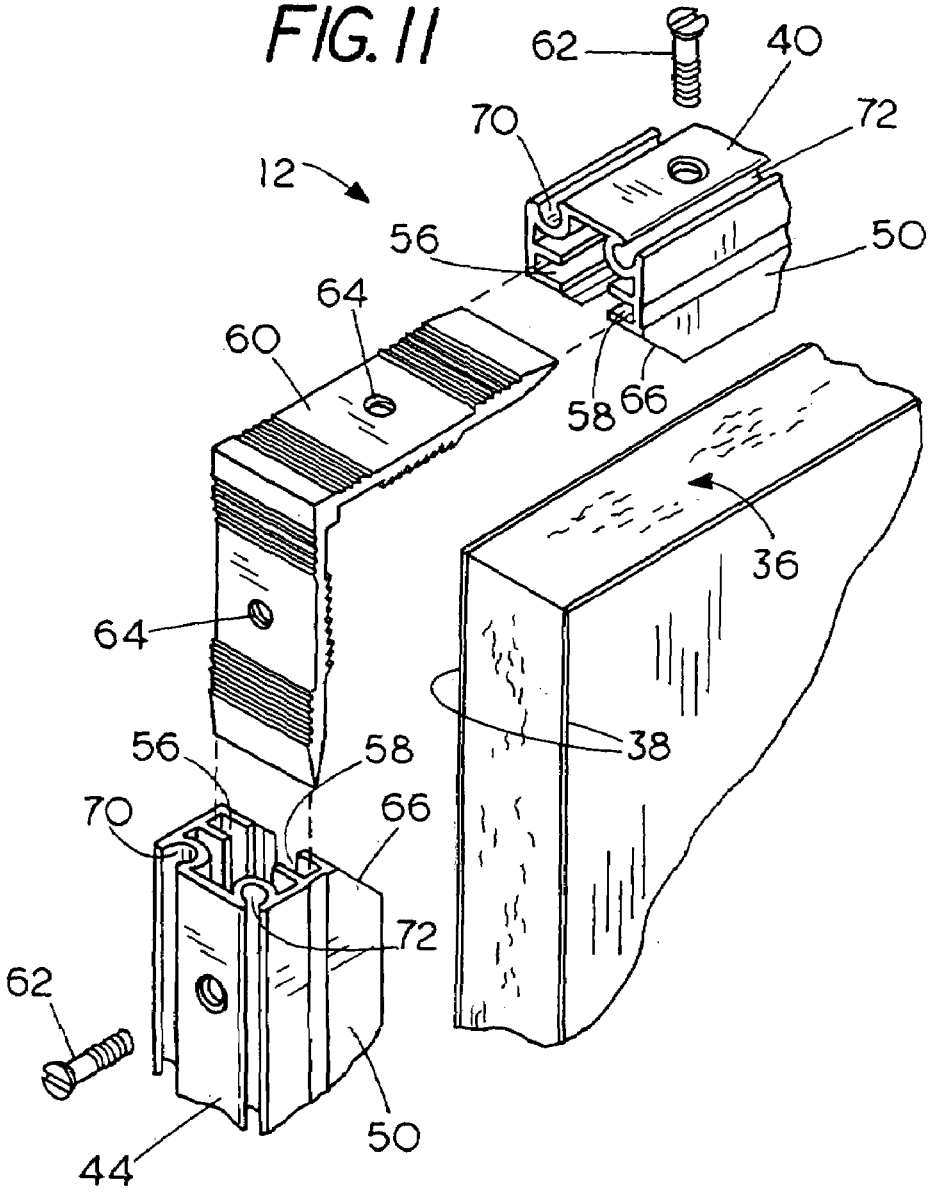
FIG. 11 is an exploded view showing the joint between a top frame member and a vertical frame member.

With reference to FIGS. 1A, 1B, 8 and 11, it will be seen that each of the panels 12–18 includes a rectangular panel core 36 formed from stiff fibrous sheet material, e.g. a commercially available paper honeycomb sheet with decorative fabric covering sheets 38 (FIG. 11). The core 36 is enclosed on all sides by a frame of four frame members (FIG. 1B) composed of identical material and includes horizontally disposed top and bottom frame members 40 and 42 and vertically disposed side frame members 44 and 46. For clarity, parts 40–46 are numbered on only one panel in FIG. 1B. All of the frame members 40–46 are composed of the same material with the same cross-sectional shape, in this case a metal, e.g. aluminum, extrusion as shown in FIGS. 7 and 11 having a pair of laterally spaced apart parallel sidewalls 50 and 52 and end wall 53 to define an opening or space 54 therebetween to receive the core 36 and a pair of aligned centrally directed recesses 56 and 58 for receiving the ends of an L-shaped metal key 60 (FIG. 11) for holding the frame members 40–46 in place around the core 36. The key 60 can be locked in its assembled position by fasteners such as screws 62 which pass through openings 64 in the key 60 once in place within the recesses 56 and 58. The ends of the sidewalls 50 and 52 are cut at a 45° angle to make a precise fit at each corner. The open ends of the frame members are preferably covered with a plastic corner cap 68 (FIG. 8). Each of the frame members 40 and 42 is also provided on each edge of its end wall 53 with outwardly opening slots 70 and 72. Both of the slots 70 and 72 have an enlarged central lumen 71 and an opening 73 (FIG. 5) of a reduced cross-section relative to the lumen 71. The axis 74 of each of the slots 70 and 72 preferably intersects a corner of the extrusions 40 and 42 and is oriented at a 45° angle to its walls.

Figure 10:
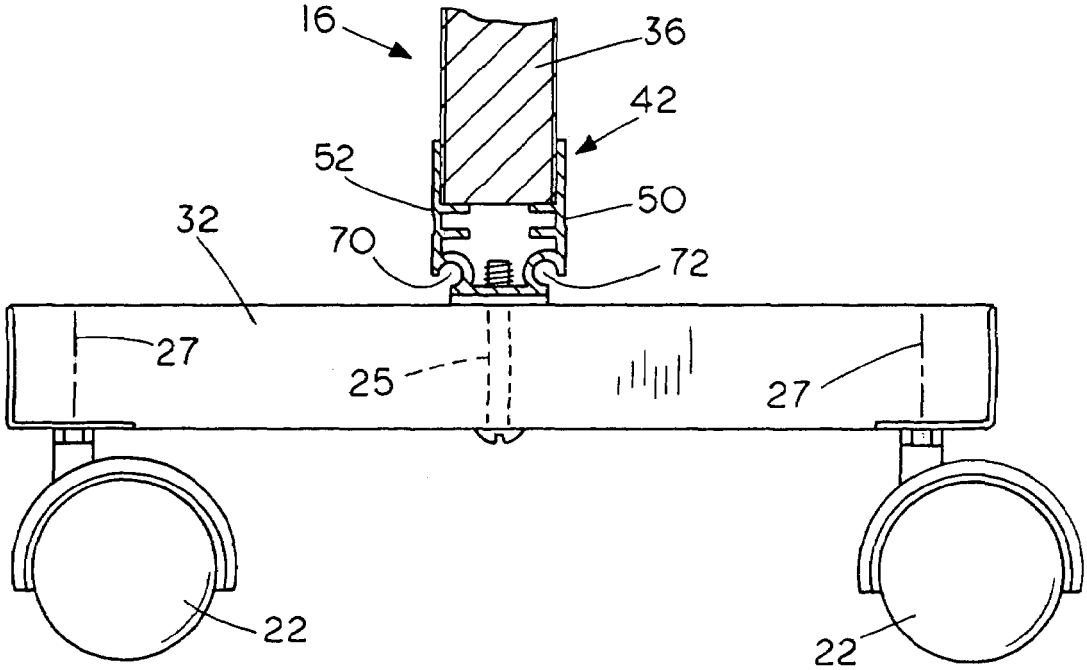
FIG. 10 is a partial vertical sectional view taken on line 10—10 of FIG. 4 on a larger scale.

As shown in FIG. 10, the wheels of the intermediate panels such as panel 16 are supported at each end of a horizontal, relatively short spread foot 23 about 5–10 inches long which is secured to the bottom frame member 42 by one or more screws 25. All of the wheels 20 and 22 are caster wheels which are each mounted for pivotal movement about a vertical axis shown at 27.

Figure 5:
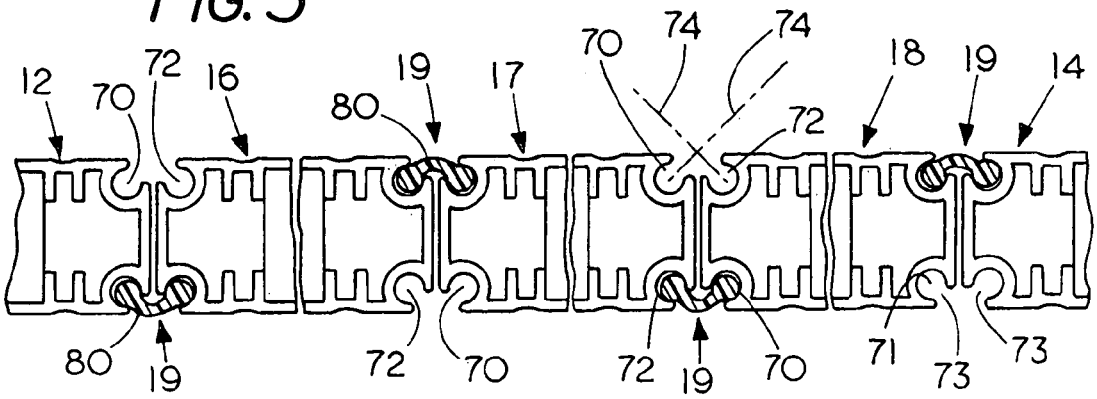
FIG. 5 is a partial horizontal sectional view of the invention on a greatly enlarged scale relative to FIG. 4.
Figure 6:
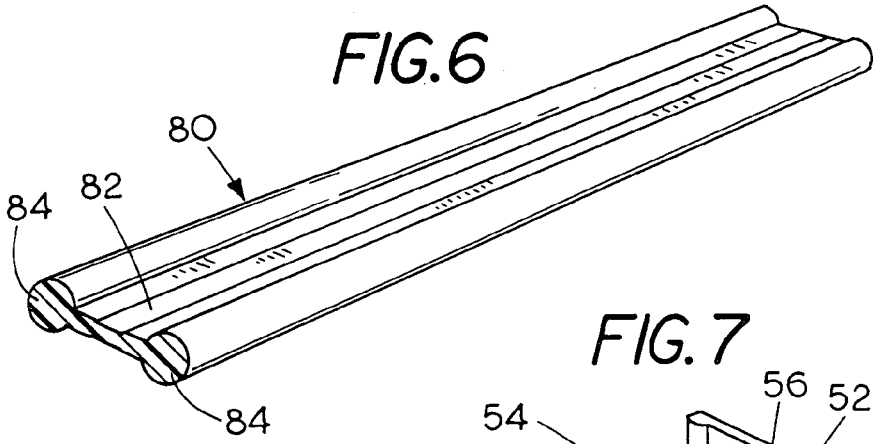
FIG. 6 is a perspective view of a section of flexible polymeric hinge material in accordance with the invention.

The hinges 19 will now be described in more detail with reference to FIGS. 5–7. Each hinge 19 includes a flexible plastic strip or ribbon 80 which can be formed from an extrusion, for example of high density polyethylene, polypropylene or flexible polyvinyl chloride having a flat center section 82 which terminates along each edge in an enlarged longitudinally extending bead 84 that is of just the proper size to provide a sliding fit within one of the recesses 70 or 72. It can be seen in FIG. 5 that when the panels 12–18 are in alignment the flexible hinge elements 80 will be flexed to assume a C-shaped configuration. It will also be noticed that the flexible hinge strips 80 are in alternate positions on opposite sides of the panel proceeding from one end of the partition to the other while the slots opposite each of the strips 80 are empty. This enables the panels to articulate through an angle of 180°. The enlarged bead 84 along each edge of the flexible hinge strip 80 is securely held in one of the slots 70 or 72 due to the reduced size of the opening 71 which is somewhat less than the cross-section of the bead 84. As shown in FIG. 7, once the flexible hinge strip 80 has been inserted, it is held in place at the end by a retainer such as a metal snap rivet 86. While the flexible hinge strips can be cycled thousands of times, should they ever become worn or broken they can easily and quickly be replaced by removing the snap rivet 86 at one end withdrawing the hinge strip and replacing it by sliding in a new one in a matter of only a few seconds. Accordingly, the hinges 19 are durable, silent, low in cost and very easily installed or removed and replaced if necessary. In addition, the C-shaped outwardly bowed configuration of the strips as shown in FIG. 5 gives the partition an attractive visual appearance in the hinge area. It will be noticed by comparing FIGS. 5 and 7 that the identical structure of frame members 40–44 on all sides of each panel simplifies production since the frame members do not have to be oriented during assembly to place slots 70 or 72 in the right position to receive the hinge strips 80; there will always be a slot in the right position for one of the strips. The adjacent slot is simply left empty. This reduces production costs in three ways. It enables a single aluminum extrusion to be used on all sides of each panel without any requirement for special orientation during assembly, it enables the low cost flexible plastic material to be employed which is much less expensive than a metallic piano hinge and it enables hinges to be rapidly assembled or replaced by unskilled workers.

Figure 9:
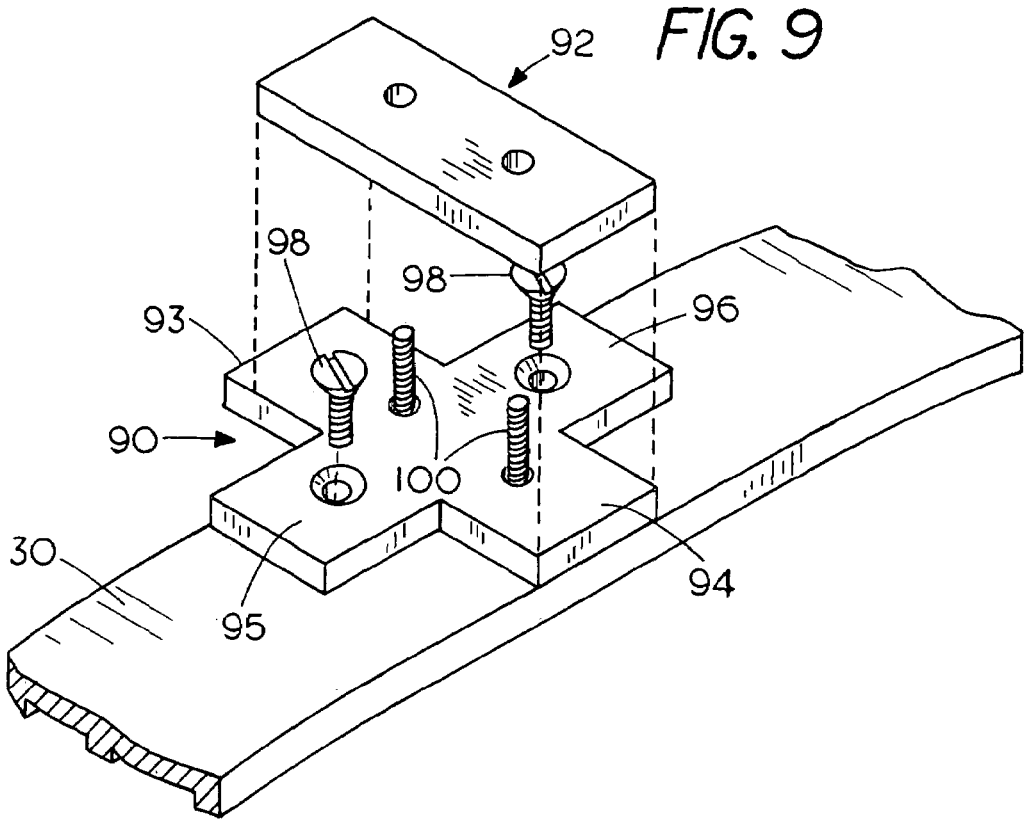
FIG. 9 is an exploded perspective view to illustrate the mounting of an end foot spreader.
Figure 12:
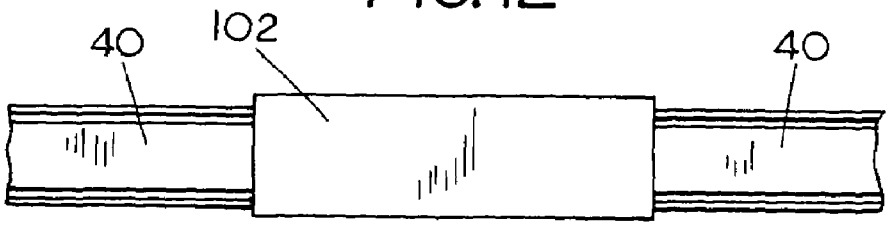
FIG. 12 is a partial plan view showing a moveable retaining member positioned between a pair of adjoining panels.
Figure 13:
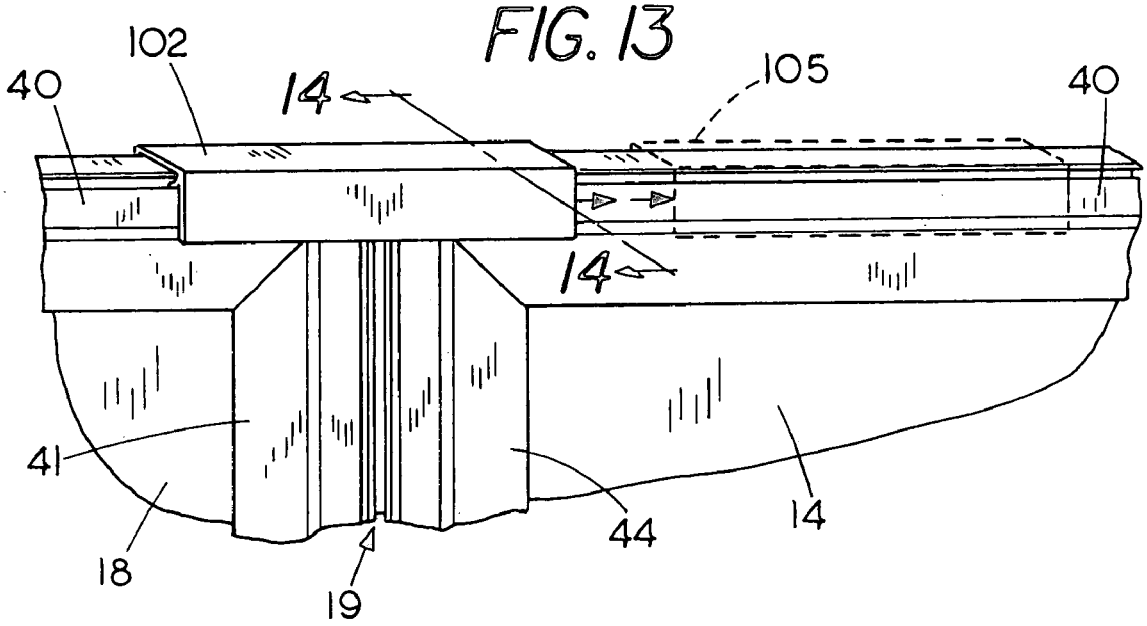
FIG. 13 is a perspective view showing a moveable retaining member connected between a pair of adjoining panels for holding them in alignment and FIG. 14 is a vertical sectional view taken on line 14—14 of FIG. 13 on a larger scale.
Figure 14:
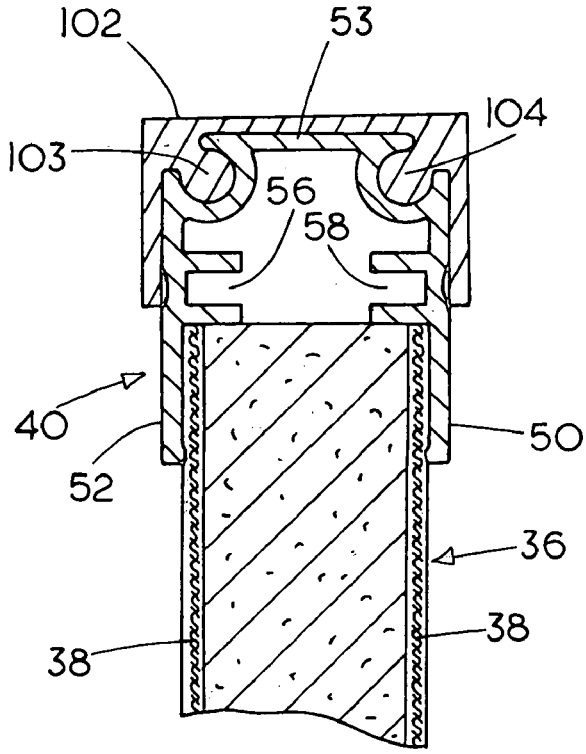

The mounting of the horizontal spread end foot 30 with wheels will now be described with reference to FIGS. 8 and 9. To provide firm and secure support for the end foot 30, a duplex mount is provided which comprises a duplex mounting plate 90 that has a pair of lateral arms 95 and 96 and a pair of longitudinal arms 93 and 94. In a preferred form of the invention, a longitudinal mounting plate 92 is provided between the plate 90 and the partition 12 and 14. The duplex mounting plate 90 is placed in contact with the end foot 30 and the longitudinal plate 92 which is above it. The plates 90 and 92 are positioned between the end foot 30 and the bottom frame member 42 substantially in alignment below the end upright 46. The upper mounting plate 92 is aligned over the arms 93 and 94 and extends longitudinally of the lower frame member 42. The lateral arms 95 and 96 are suitably secured to the spread end foot 30, e.g. by welding, but preferably by fasteners such as laterally spaced apart bolts or screws 98 while both plates are secured to the bottom frame member 42 by longitudinally spaced apart bolts or screws 100 which are screw threaded into the lower frame member 42 and the key 60 (FIG. 11) that is connected between adjacent frame members 42 and 46 thereby providing firm, stable and reliable support for the horizontal spread end foot 30 so as to prevent it from rocking from side to side or working loose. Refer now to FIGS. 12–14.

To achieve a wall-effect, a movable bridging element 102 is slidably mounted on the top of each panel 12–18 adjacent to each hinge 19. The bridging element 102 is provided with internal projections 103 and 104 which are slidably mounted within the slots 70 and 72 (FIG. 14) allowing the bridge 102 to be slid manually from an inoperative position 105 (FIG. 13) to an operative position shown in solid lines in FIGS. 12 and 13 extending across the hinge area 19. By placing all of the bridge elements 102 in the operating position of FIGS. 12 and 13, all of the panels 12–14 will be in alignment giving the partition 10 the character of a flat wall.

It has been expensive in the past to build separate cubicles for different activities conducted in an office setting or in an educational or religious institution wherever a space must be divided quickly, e.g. for meeting. The present invention overcomes the problems associated with prior partitions partly because it is less expensive yet easy to set up and put away. Moreover, the novel hinge having a novel construction makes possible a low cost unit that can be quickly and inexpensively assembled. In addition, the carrier panels 12 and 14 provide sturdy support for intermediate panels 16–18, especially when the panel is being expanded or collapsed. The hinges, in addition, are silent, inexpensive to produce and can be quickly assembled or replaced. The alignment of the handles 24 in the plane of the carrier panels 12 and 14 and directly over the plane of the wheels 20 at each end of the partition adds to the stability of the partition as the partition is expanded. It will be noted that the panels 12 and 14 themselves are aligned with the forces applied to the handles as they are being pulled apart and both sets of carrier wheels 20 will be aligned with the plane of the carrier panels as the partition is being unfolded (FIGS. 1A and 1B).

Many variations of the present invention within the scope of the appended claims will be apparent to those skilled in the art once the principles described herein are read and understood.

What is claimed is:

1. A portable folding room dividing partition comprising,
a plurality of articulated panels,
vertical hinges connected between the panels,
two of the panels located at the ends of the partition comprise carrier panels to stabilize and impart movement to the remaining panels as the partition is expanded or collapsed,
each of the carrier panels having a vertical end frame member with a horizontal spread end foot at the lower end thereof with wheels thereon,
a duplex mount rigidly connecting the spread end foot to a bottom end of each carrier panel and at right angles thereto, said duplex mount having a part thereof connected to a carrier panel and a part thereof connected to the spread end foot,
a pull handle that is spaced apart from the spread end foot and connected to the vertical end frame member in alignment with the plane of the carrier panel and above a center portion of each spread end foot,
a plurality of inactive intermediate panels with wheels connected by means of said hinges to one another and to the carrier panels to define said partition,
such that movement of the carrier panels by a person gripping the pull handles acts to spread or collapse the inactive panels while providing support that helps prevent the partition from tipping and
a bridging element which is provided with an internal retaining member that is slidably mounted within a slot at the top of each panel.

2. A portable folding room dividing partition comprising,
a plurality of articulated panels,
vertical hinges connected between the panels,
two of the panels located at the ends of the partition comprise carrier panels to stabilize and impart movement to the remaining panels as the partition is expanded or collapsed,
each of the carrier panels having a vertical end frame member with a horizontal spread end foot at the lower end thereof with wheels thereon,
a duplex mount rigidly connecting the spread end foot to a bottom end of each carrier panel and at right angles thereto, said duplex mount having a part thereof connected to a carrier panel and a part thereof connected to the spread end foot,
a pull handle that is spaced apart from the spread end foot and connected to the vertical end frame member in alignment with the plane of the carrier panel and above a center portion of each spread end foot and,
a plurality of inactive intermediate panels with wheels connected by means of said hinges to one another and to the carrier panels to define said partition,
such that movement of the carrier panels by a person gripping the pull handles acts to spread or collapse the inactive panels while providing support that helps prevent the partition from tipping,
the hinges are formed from strips of flexible resinous material having parallel edges secured between the adjacent panels of the partition and positioned alternately on opposite sides thereof and each panel includes a core surrounded by vertically disposed side frame members, horizontally disposed top and bottom frame members and all such frame members have the same cross-sectional configuration including outwardly opening slots with the edges of the strips held in vertical slots and a bridging member slidably mounted within horizontal slots for holding the panels in alignment.

3. A portable folding room dividing partition comprising, a plurality of articulated panels, vertical hinges connected between the panels, each of the panels including a central core formed from sheet material, a pair of horizontally disposed top and bottom frame members, vertically disposed side frame members along each side of each panel and, at least the vertical frame members having a pair of laterally spaced apart sidewalls and an end wall and having outwardly opening longitudinally extending slots between the end wall and each of the sidewalls, hinges are formed from strips of flexible plastic material connected between the slots on the same side of adjacent panels to allow the partitions to articulate relative to one another and, the panels have wheels and are connected to one another by means of said hinges and to the carrier panels to define said partition, at least one panel at one end of the partition includes, a horizontally disposed laterally extending spread end foot with caster wheels at the end thereof, the spread end foot is connected to a longitudinally extending bottom frame member by a duplex mounting plate having laterally extending arms that are aligned over the spread end foot and are rigidly connected thereto and a pair of longitudinally extending arms.

4. The apparatus of claim 3 wherein a longitudinal plate is sandwiched between the longitudinal arms and the bottom frame member.

5. A portable folding room dividing partition comprising, a plurality of articulated panels, vertical hinges connected between the panels, two of the panels located at the ends of the partition comprise carrier panels to stabilize and impart movement to the remaining panels as the partition is expanded or collapsed, each of the carrier panels having a vertical end frame member with a horizontal spread end foot at the lower end thereof with wheels thereon, a duplex mount rigidly connecting the spread end foot to a bottom end of each carrier panel and at right angles thereto, said duplex mount having a part thereof connected to a carrier panel and a part thereof connected to the spread end foot, a pull handle that is spaced apart from the spread end foot and connected to the vertical end frame member in alignment with the plane of the carrier panel and above a center portion of each spread end foot and, a plurality of inactive intermediate panels with wheels connected by means of said hinges to one another and to the carrier panels to define said partition, such that movement of the carrier panels by a person gripping the pull handles acts to spread or collapse the inactive panels while providing support that helps prevent the partition from tipping and, the wheels at the end of the spread end foot are caster wheels mounted for pivotal movement and, the duplex mount has laterally extending arms that are aligned over the spread end foot and are rigidly connected thereto and at least one longitudinally extending arm connected to a carrier panel.

6. The apparatus of claim 5 wherein a longitudinal plate is sandwiched between a longitudinal arm and a bottom frame member of a carrier panel.

7. A portable folding room dividing partition comprising, a plurality of articulated panels, vertical hinges connected between the panels, two of the panels located at the ends of the partition comprise carrier panels to stabilize and impart movement to the remaining panels as the partition is expanded or collapsed, each of the carrier panels having a vertical end frame member with a horizontal spread end foot at the lower end thereof with wheels thereon, a duplex mount rigidly connecting the spread end foot to a bottom end of each carrier panel and at right angles thereto, said duplex mount having a part thereof connected to a carrier panel and a part thereof connected to the spread end foot, a pull handle that is spaced apart from the spread end foot and connected to the vertical end frame member in alignment with the plane of the carrier panel and above a center portion of each spread end foot and, a plurality of inactive intermediate panels with wheels connected by means of said hinges to one another and to the carrier panels to define said partition, such that movement of the carrier panels by a person gripping the pull handles acts to spread or collapse the inactive panels while providing support that helps prevent the partition from tipping and the duplex mount has lateral wings connected to the spread end foot and longitudinal arms that are connected to the bottom end of a carrier panel.

* * * * *